US006178245B1

(12) United States Patent
Starkey et al.

(10) Patent No.: US 6,178,245 B1
(45) Date of Patent: Jan. 23, 2001

(54) AUDIO SIGNAL GENERATOR TO EMULATE THREE-DIMENSIONAL AUDIO SIGNALS

(75) Inventors: David Thomas Starkey; Anthony Martin Sarain, both of La Jolla, CA (US)

(73) Assignee: National Semiconductor Corporation, Santa Clara, CA (US)

( * ) Notice: Under 35 U.S.C. 154(b), the term of this patent shall be extended for 0 days.

(21) Appl. No.: 09/548,077

(22) Filed: Apr. 12, 2000

(51) Int. Cl.[7] ..... H04R 5/00; H04R 5/02

(52) U.S. Cl. ..... 381/17; 381/1; 381/309; 381/310

(58) Field of Search ..... 381/1, 17–19, 381/309, 310, 300, 26, 74, 97–99, 320, 321, FOR 126, 61, 63

(56) References Cited

U.S. PATENT DOCUMENTS

| | | | | |
|---|---|---|---|---|
| 4,817,149 | * | 3/1989 | Myers | 381/63 |
| 5,173,944 | | 12/1992 | Begault | 381/17 |
| 5,272,757 | * | 12/1993 | Scofield et al. | 381/309 |
| 5,438,623 | | 8/1995 | Begault | 381/17 |
| 5,581,618 | * | 12/1996 | Satoshi et al. | 381/17 |
| 5,596,644 | | 1/1997 | Abel et al. | 381/17 |
| 5,729,612 | * | 3/1998 | Akel et al. | 381/17 |
| 5,742,689 | * | 4/1998 | Tucker et al. | 381/17 |
| 5,751,817 | * | 5/1998 | Brungart | 381/309 |
| 5,761,314 | * | 6/1998 | Inanaga et al. | 381/17 |
| 5,764,777 | * | 6/1998 | Goldfarb | 381/300 |
| 5,928,311 | * | 7/1999 | Leavy et al. | 381/97 |
| 5,943,427 | * | 8/1999 | Massie et al. | 381/17 |
| 6,011,754 | * | 1/2000 | Burgess et al. | 367/116 |
| 6,021,200 | * | 2/2000 | McGrath | 381/310 |
| 6,035,045 | * | 3/2000 | Fujita et al. | 381/1 |

* cited by examiner

*Primary Examiner*—Vivian Chang
*Assistant Examiner*—Xu Mei
(74) *Attorney, Agent, or Firm*—Limbach & Limbach L.L.P.

(57) ABSTRACT

A system produces, based on samples of a single-channel input audio signal and an indication of a particular orientation of the listener relative to a source of the audio signal, a multi-channel output audio signal that emulates an audio signal as emanating from the source having the particular orientation to the listener. Interaural time delay (ITD) circuitry generates, from the single-channel input audio signal, a first left channel audio signal and a first right channel audio signal, wherein the first left channel audio signal and the first right channel audio signal are each based on the single-channel input audio signal but differ from each other at least with respect to phase based on the indication of the particular orientation. Azimuth frequency compensating (AFC) circuitry modifies the first left channel audio signal and the first right channel audio signal based on an azimuth, relative to the listener's left ear and right ear, respectively, of the particular orientation. High frequency cuing (HFC) circuitry intensifies high frequencies of the first left channel audio signal and the first right channel audio signal based on whether the source is on axis with an ear canal of the listener's left ear and right ear, respectively.

9 Claims, 2 Drawing Sheets

AUDIO SIGNAL GENERATOR TO EMULATE THREE-DIMENSIONAL AUDIO SIGNALS

TECHNICAL FIELD

This invention relates to the generation of audio signals appearing to a listener perceiving the signals to originate from a particular direction and distance, more particularly to a method and apparatus for efficient generation of these signals.

BACKGROUND

In many applications, it is desirable to produce audio signals that appear, to a listener perceiving the signals, to originate from a particular direction at a particular distance. This is even though the audio signals are provided from a fixed source (e.g., stereo loudspeakers). In these applications, an input audio signal may be provided to an audio signal processor, along with parameters of direction and distance, such as elevation angle and azimuth angle, relative to the front face of a listener. A system or method, ideally, receives/processes an audio signal and generates left and right audio signals responsive to a head-related transfer function (HRTF) so that the left and right audio signals, when broadcast to the listener, appear to originate from the desired direction and distance (parameters).

In order to create a system that may generate signals appearing to originate from particular directions, the head response of a human model has been determined for signals originating at various locations about the head of the human model. In one particular study, signals were broadcast from 710 different positions at various elevation and azimuth angles about the head of the human model, and received by microphones planted in each ear canal of the model. The results of the measurements were reported in: "HRTF Measurements of a KEMAR Dummy-Head Microphone," Gardner and Martin, MIT Media Lab Perceptual Computing—Technical Report #280, May 1994.

In the Gardner and Martin study, the impulse response for the left and right ear was determined for signals broadcast from each of the 710 locations. More specifically, a known input signal was broadcast from each broadcast position and the signals received by the microphones in the left and right ears of the human model were recorded. The impulse response was determined from the convolution of the known input signal and of the recorded signals received by the left ear and right ear microphones. The study produced 710 impulse responses having a minimal length of 128 samples, each sample being 16 bits. Using the impulse responses generated by this study, left and right audio signals can be generated that when broadcast will appear to originate from one of the 710 locations. Convolving an input signal with the impulse response of the desired origin or location generates three-dimensional left and right audio signals. This technique has proven to provide satisfactory "three-dimensional" signals.

However, the technique just described has a significant shortcoming in that it is computationally complex. That is, in order to determine a single sample to be broadcast for a left or right channel, 128 multiplications and summations must be performed. Thus, for each sample a total of 256 multiplications and summations must be performed —128 for the left channel and 128 for the right channel. If there are multiple sound sources, as in some applications, the number of multiplications and summations is equal to 256 times the number of sound sources for each sample. In addition, memory must be provided so that the 710 different 128, 16-bit impulse responses can be stored and retrieved for each sound source. Thus, it can be seen that to produce three-dimensional signals using convolution of impulse responses, a high-speed processor and a considerable amount of RAM and lookup tables may be required. For all but the most powerful systems, this will severely limit a system's ability to perform other functions, sound related or otherwise.

In order to reduce the computational complexity of this technique, modifications of this technique have been developed. For example, U.S. Pat. Nos. 5,173,944 and 5,438,623 disclose using a smaller set of impulse responses, and at only selected locations. When an impulse response is needed at a location not in the set, the impulse response is interpolated from the impulse response in the set about the desired location. While this technique reduces the size of the lookup table and required RAM, but it does not reduce the number of computations required to generate each sample of the three-dimensional audio signals. U.S. Pat. No. 5,596,644 breaks the impulse response of HRTF into components using a singular value decomposition process. This technique may reduce the computational complexity, but still requires a large number of computations to generate three-dimensional audio signals.

Thus, there is a need for an apparatus or method of generating three-dimensional audio signals using a reduced set of computations.

SUMMARY

A system produces, based on samples of a single-channel input audio signal and an indication of a particular orientation of the listener relative to a source of the audio signal, a multi-channel output audio signal that emulates an audio signal as emanating from the source having the particular orientation to the listener.

The system includes interaural time delay (ITD) circuitry that generates, from the single-channel input audio signal, a first left channel audio signal and a first right channel audio signal, wherein the first left channel audio signal and the first right channel audio signal are each based on the single-channel input audio signal but differ from each other at least with respect to phase based on the indication of the particular orientation.

The system further includes azimuth frequency compensating (AFC) circuitry that modifies the first left channel audio signal and the first right channel audio signal based on an azimuth, relative to the listener's left ear and right ear, respectively, of the particular orientation.

The system also includes high frequency cuing (HFC) circuitry that intensifies high frequencies of the first left channel audio signal and the first right channel audio signal based on whether the source is on axis with an ear canal of the listener's left ear and right ear, respectively.

DETAILED DESCRIPTION

Before describing embodiments of the invention in detail, it is useful to describe some principles on which the invention operates. The HRTF ("head related transfer function") models several characteristics of how three-dimensional sound is perceived by the left and right ear of a listener. These characteristics include an interaural time delay (ITD); an interaural intensity difference (IID); an azimuth frequency compensation (AFC); and a high-frequency cuing (HFC).

Figure 1:
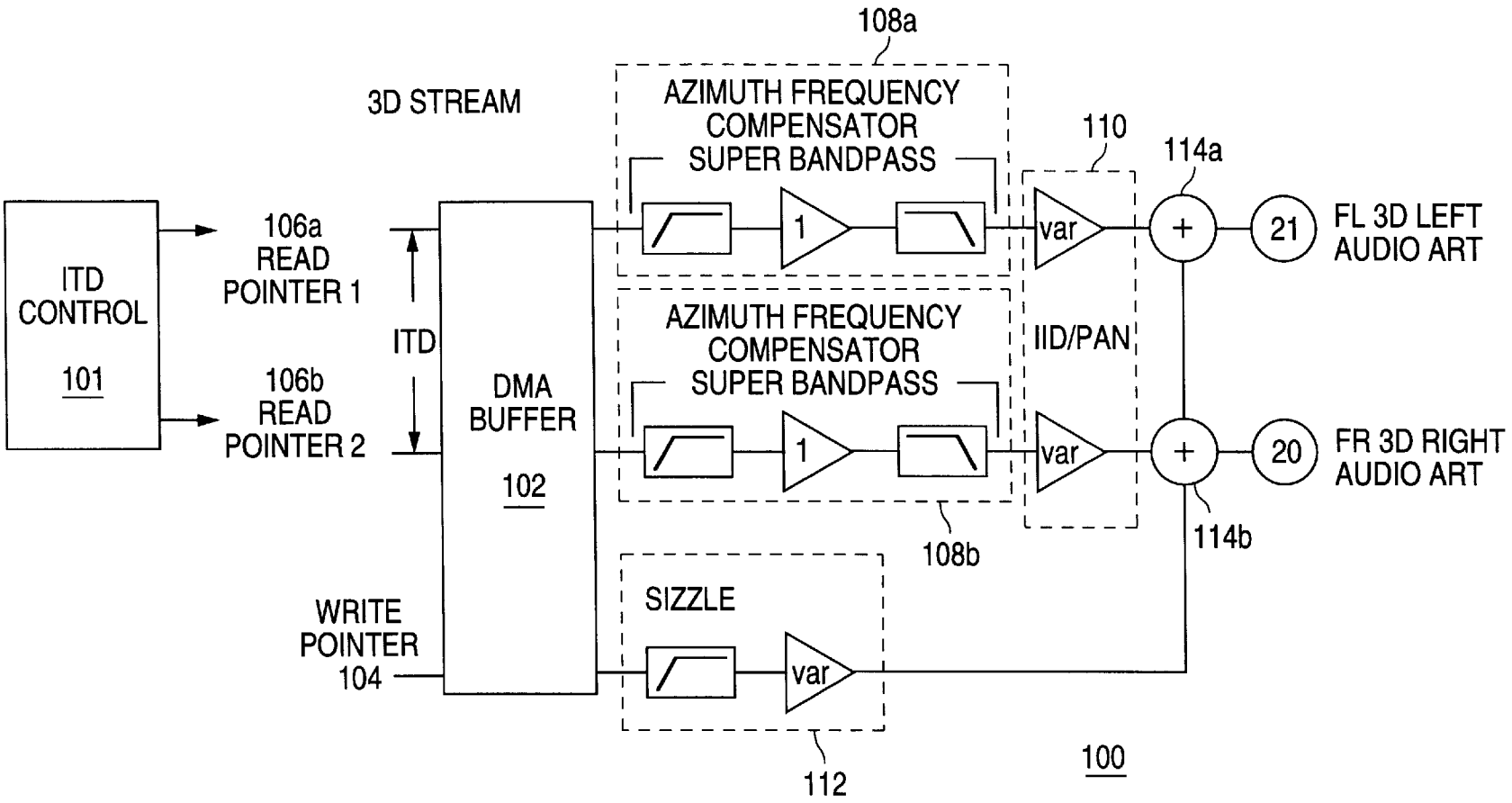
FIG. 1 schematically illustrates a circuit in accordance with one embodiment of the invention.

The invention is now described beginning with reference to FIG. 1, which illustrates an HRTF modelling circuit in accordance with an embodiment of the invention. Specifically, in FIG. 1, a three-dimensional audio generator 100 is illustrated in block form. In operation, generator 100 receives an audio signal, and parameters, and produces a three-dimensional output audio signal that comprises a left and right audio signal (LEFT AUDIO OUT and RIGHT AUDIO OUT). In a preferred embodiment of the invention, the received audio signal has a sample rate of 48 KHz, although the rate can be any value. The higher the rate of received audio, the more high frequency information is included in the received audio signal, which allows for an enhanced three-dimensional effect of the processing by the generator 100. The received parameters include the desired azimuth angle, elevation and distance parameter of the output three-dimensional audio signal. Generator 100 produces a combination of left and right output audio signals that appears to a listener perceiving the signals to be the received audio signal originating from the azimuth angle, elevation, and distance. As discussed in the Background, the HRTF models how a listener perceives three-dimensional sound.

Referring specifically to the FIG. 1 embodiment, it can be seen that digital samples of an audio signal are stored into a buffer 102 (in the FIG. 1 embodiment, by a DMA process). A current position for writing into the buffer 102 is pointed to by a write pointer 104. In addition, two read pointers into the buffer 102 are maintained. Read pointer 106*a* is maintained for a left channel output signal and read pointer 106*b* is maintained for a right channel output signal.

The ITD is the time difference between the onset of perception of a sound in one ear as related to perception in the other ear. Referring to the FIG. 1 embodiment, an ITD control circuit 101 controls a difference in the read pointers 106*a* and 106*b* to model the ITD constituent of the HRTF model. In general, the ITD is controlled by ITD control circuit 101 to vary as a function of the azimuth angle of the audio source. Ideally, ITD does not vary significantly as a function of distance and elevation. Preferably, as azimuth angle changes, the ITD controller 101 controls the read pointers 106*a*, 106*b* in a sweeping fashion according to the velocity of the sound source. In addition, in one embodiment, the sampling frequency of reading from the buffer 102 is varied according to the velocity of the sound source, thus eliminating noise artifacts that would otherwise result from the change in position.

AFC models the filtering effects of the ears. As an audio source is moved off-axis from the ear canal, the signal is low-pass filtered. The amount of low-pass filtering increases as the distance off-axis increases. Other filtering gives further clues as to the position of the sound source. In the FIG. 1 embodiment, AFC control is performed by the circuit blocks 108*a* (for left channel) and 108*b* (for right channel). The AFC circuit blocks 108*a* and 108*b* employ stored tables of filter types and settings. In one embodiment, the filter settings vary in 5 degree increments in azimuth and elevation and the stored table values are determined empirically. In terms of the frequency spectrum of a signal, high frequencies for an ear are normally suppressed when the audio source is located behind or at an opposite side of that ear. More generally, high frequencies from a source are attenuated unless the source is approximately on line with the canal of the ear. Low frequencies, however, are not normally suppressed significantly when the audio source is located behind or at an opposite side of an ear of a listener.

The IID, handled by circuit block 110 in the FIG. 1 embodiment, represents differences in amplitudes of signals received at a listener's left and right ear. The IID is a secondary cue for left/right position. The volume difference is generally relatively small, usually no more than about 6 dB, and is typically at frequencies greater than about 5400 Hz. The IID is calculated by circuit block 110 using the azimuth angle of the audio source. Volume changes with change in azimuth angle are preferably swept with an envelope to suppress clicking.

HFC control circuit 112 is employed to determine a high-frequency component of the audio signal, based on the sampled audio signal in memory 102, to be summed into the final signal for each channel (by adders 114*a* and 114*b*) to give further cues as to the azimuthal direction of the audio source. The HFC control circuit 112 varies the high frequency component intensity according to azimuth direction, the intensity being greatest when the signal is on axis with the ear canal. In one embodiment, the HFC control circuit 112 varies high frequency cuing according to a stored value table that is indexed by azimuth, with the table being quantized in 5-degree increments. The table may be symmetrical so that only 180 degrees of values need be stored.

Figure 2:
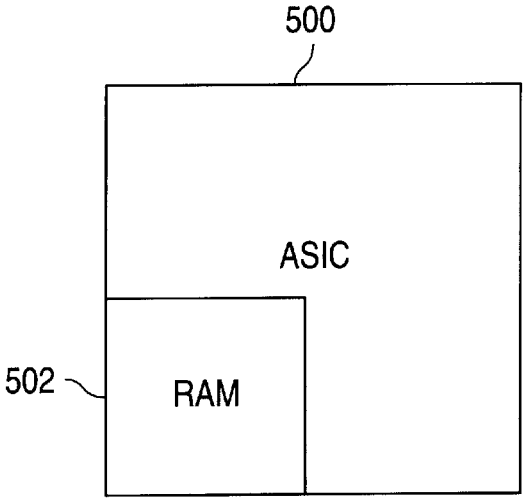
FIG. 2 illustrates an ASIC embodiment of the FIG. 1 circuit.

Referring to FIG. 2, in one embodiment of the invention, threedimensional audio generator 100 is implemented in an Application Specific Integrated Circuit ("ASIC") 500 having a RAM 502, with the ASIC being configured to perform the operations of the unit 100 as described above. One ASIC (or DSP) useable for implementing the operations of the generator 100 is a Gulbransen G392DSE which is described in detail in the reference Gulbransen G392DSE Digital Synthesis Engine, User's Manual, 1996. As discussed in the aforementioned, the G392DSE ASIC includes a plurality of Audio Processing Units (APUs) which may be configured to perform filtering and other functions. RAM 502 is used to store data produced by the APUs at various stages of processing of a received input audio signal.

Figure 3:
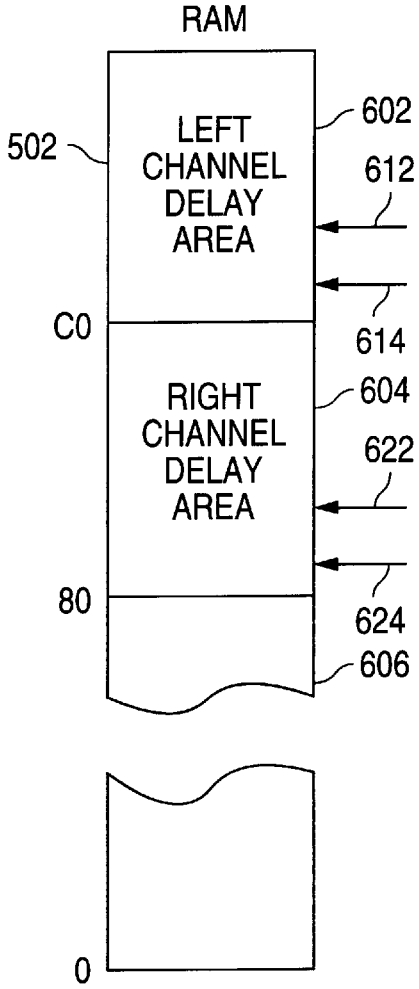
FIG. 3 illustrates one possible RAM configuration of the ASIC embodiment of FIG. 2.

In one embodiment of the invention, RAM 502 is not equivalent to the RAM described in the G392DSE User's Manual. Rather, a RAM 502 is configured as shown in FIG. 3. In this embodiment, the G392DSE ASIC is programmed to include RAM 502 and the appropriate functions to communicate with RAM 502 as described below.

As shown in FIG. 3, in this embodiment, RAM 502 is segmented into a left channel delay area 602, right channel delay area 604 and general use area 606. In one embodiment of the invention, RAM 502 is 24 bits wide and the left and right channel delay areas each consist of 64 words. Further, in this embodiment the left and right delay channel areas 602 and 604 are configured as circular buffers. In this embodiment, two words are written or read at a time during each access to the RAM 502 in order to increase the efficiency of data transfers. As a consequence, the left and right channel delay areas 602 and 604 are circular buffers having 32 entries or access locations of 2 (24-bit) words.

During normal processing, the left and right channel input audio signals are written to the circular queues of the left and right channel delay areas 602, 604 of RAM 502. Specifically, four 24-bit words representing two left and right channel audio signal samples are written to the top of the each circular queue during each program cycle of the APUs. The pointer of each circular queue starts at the beginning of its respective memory area (of the queue) and writes data contiguously until the end of the circular queue is reached. Then, the pointer starts overwriting data at the bottom of the queue or buffer. Pointers 612, 614, 622 and 624 are used to manage the circular queues. The use of circular queues ensures that the 64 most recent left and right channel audio signal samples are stored in the RAM 502 at any particular time (after initial startup).

With the FIG. 3 implementation, the ITD control circuit 101 causes left and right channel audio signal samples to be retrieved from the left and right channel areas 602 and 604 of the RAM 502 as a function of the interaural time delay between the left and right channels (or ears). That is, the ITD control circuit 102 causes the left channel audio signal samples to be retrieved from the left channel delay area 602 of the RAM 502 based on the position of delay pointer 612. The position of delay pointer 612 is determined as a function of the azimuth angle parameter and the current position of the top of the circular queue, i.e., where the latest left channel audio signal samples have been written. The distance between the top of the queue for the left channel delay area 602 and the left delay pointer 612 determines the amount of delay of retrieved left channel audio signal samples. As discussed above, in one embodiment of the invention, samples are generated at a rate of 48 KHz. As a consequence, in that embodiment, delays of up to 63/48 KHz can be simulated for either the left or right channel audio signals. (This is limited to 63/48 KHz because data is transferred in-groups of two words are noted above.)

Optionally, the three-dimensional audio generator includes reverberation control circuitry that operates in a manner similar to the ITD control circuitry 101. That is, the reverberation control circuitry produces delayed, attenuated left and right channel audio signal samples and adds these samples to the left and right channel audio signal samples produced as a result of ITD control. Referring to FIG. 3, pointers 614 and 624 are employed to accomplish this reverberation control. The reverberation delay and attenuation are controlled based on the input elevation parameter. In order to create multiple reverberations, additional reverberation pointers may be employed to retrieve additional left channel audio signal samples which are also attenuated and added to the left channel audio signal samples provided as a result of control by ITD control circuit 101.

The left and right channel audio signals samples provided from adders 114*a* and 114*b* are the left and right channel audio signal samples, respectfully, that when converted to analog signals and broadcast to a listener, represent an emulated three-dimensional audio signal based on the received audio signal and parameters.

This description is not meant to limit the scope of the invention to the particular described embodiments. For example, variable pass filters can be employed in place of the pass filters of various components of the generator 100, where the filter characteristics may be varied as a function of the elevation parameter, for example.

What is claimed is:

1. A system to produce, based on samples of a single-channel input audio signal and an indication of a particular orientation of the listener relative to a source of the audio signal, a multi-channel output audio signal that emulates an audio signal as emanating from the source having the particular orientation to the listener, the system comprising:

interaural time delay (ITD) circuitry that generates, from the single-channel input audio signal, a first left channel audio signal and a first right channel audio signal, wherein the first left channel audio signal and the first right channel audio signal are each based on the single-channel input audio signal but differ from each other at least with respect to phase based on the indication of the particular orientation;

azimuth frequency compensating (AFC) circuitry that modifies the first left channel audio signal and the first right channel audio signal based on an azimuth, relative to the listener's left ear and right ear, respectively, of the particular orientation; and high frequency cuing (HFC) circuitry that intensifies high frequencies of the first left channel audio signal and the first right channel audio signal based on whether the source is on axis with an ear canal of the listener's left ear and right ear, respectively.

2. The system of claim 1, wherein the AFC circuit includes:

high pass filter circuitry;

low pass filter circuitry; and filter control circuitry, the filter control circuitry controlling the high pass filter circuitry and the low pass filter circuitry based on the azimuth.

3. The system of claim 2, wherein the filter control circuitry operates based on control parameters empirically determined for the combinations of particular azimuth and elevation angles.

4. The system of claim 2, wherein:

the filter control circuitry operates based on entries in a filter control table, the filter control table including entries relating combinations of particular azimuth and elevation angles of the particular orientation to settings of the high pass filter circuitry and the low pass filter circuitry.

5. The system of claim 4, wherein the combinations of particular azimuth and elevation angles are in five-degree increments.

6. The system of claim 1, wherein:

the HFC circuitry includes an HFC volume table having entries for particular azimuth angles; and the HFC circuitry intensifies the high frequencies based on the entry in the HFC volume table corresponding to the azimuth angle of the orientation.

7. The system of claim 1, wherein:

the ITD includes a read/write memory and pointer control circuitry to control read pointers into the read/write memory; and the pointer control circuitry controls the read pointers based on an azimuth angle of the orientation.

8. The system of claim 7, wherein:

the indication of the particular orientation includes an indication of a velocity of movement of the source; and the pointer control circuitry further controls the read pointers based on indication of velocity.

9. The system of claim 8, wherein the pointer control circuitry controls the read pointers based on the indication of velocity such that, as the velocity is increased, a rate of reading increases correspondingly.

* * * * *